US005992983A

United States Patent [19]

Takahashi et al.

[11] Patent Number: 5,992,983

[45] Date of Patent: Nov. 30, 1999

[54] LIQUID JET RECORDING HEAD

[75] Inventors: Hiroto Takahashi, Hiratsuka; Masami Ikeda, Machida; Hiroto Matsuda, Ebina; Makoto Shibata, Hiratsuka, all of Japan

[73] Assignee: Canon Kabushiki Kaisha, Tokyo, Japan

[21] Appl. No.: 08/473,987

[22] Filed: Jun. 7, 1995

Related U.S. Application Data

[62] Division of application No. 08/355,091, Dec. 12, 1994, Pat. No. 5,451,994, which is a continuation of application No. 08/258,604, Jun. 10, 1994, abandoned, which is a continuation of application No. 08/026,169, Mar. 1, 1993, abandoned, which is a continuation of application No. 07/821,905, Jan. 15, 1992, abandoned, which is a continuation of application No. 07/477,148, Feb. 8, 1990, abandoned, which is a continuation of application No. 07/296,303, Nov. 9, 1989, abandoned, which is a continuation of application No. 07/009,062, Jan. 27, 1987, abandoned, which is a continuation of application No. 06/674,877, Nov. 26, 1984, abandoned.

[30] Foreign Application Priority Data

| | | | |
|---|---|---|---|
| Nov. 30, 1983 | [JP] | Japan | 58-224266 |
| Nov. 30, 1983 | [JP] | Japan | 58-224267 |

[51] Int. Cl.[6] ..... B41J 2/05

[52] U.S. Cl. ..... 347/64

[58] Field of Search ..... 347/64, 63, 62

[56] References Cited

U.S. PATENT DOCUMENTS

| | | | |
|---|---|---|---|
| 4,243,994 | 1/1981 | Kobayashi | 347/56 |
| 4,251,824 | 2/1981 | Hara | 347/57 |
| 4,335,389 | 6/1982 | Shirato | 347/64 |
| 4,392,907 | 7/1983 | Shirato et al. | 347/63 |
| 4,450,457 | 5/1984 | Miyachi | 347/64 |
| 4,458,256 | 7/1984 | Shirato | 347/58 |
| 4,567,493 | 1/1986 | Ikeda et al. | 347/64 |
| 4,577,202 | 3/1986 | Hara | 347/64 |
| 4,626,875 | 12/1986 | Hara et al. | 347/56 |
| 4,675,693 | 6/1987 | Yano et al. | 347/63 |
| 4,694,306 | 9/1987 | Ikeda et al. | 347/64 |

FOREIGN PATENT DOCUMENTS

| | | | |
|---|---|---|---|
| 3011919 | 10/1980 | Germany | B41J 3/04 |
| 3231431 | 3/1983 | Germany | B41J 3/04 |
| 2007162 | 10/1982 | United Kingdom . | |

*Primary Examiner*—Joseph Hartary

*Attorney, Agent, or Firm*—Fitzpatrick, Cella, Harper & Scinto

[57] ABSTRACT

A liquid jet recording head for discharging liquid droplets onto a recording medium includes a support, heat-generating resistance layer provided on the support for generating heat energy to discharge the liquid droplets, a pair of electrodes electrically connected to the heat-generating resistance layer, and heat-generating sections each serving as a portion for generating the heat energy, each head generating section comprising the heat-generating resistance layer sandwiched by the pair of electrodes. Plural discharge openings serve to discharge liquid droplets, a liquid chamber houses liquid, and there are plural liquid paths, each liquid path having an associated heat generating section, and communicating with an associated discharge opening and with the liquid chamber to supply liquid to the associated discharge opening from the liquid chamber. An layer on the support protects the heat-generating resistance layer and pair of electrodes, and the upper layer has an organic resin layer of organic material, and this organic resin layer is formed only on a whole region upstream of the heat-generating sections on the support in a liquid supply direction.

4 Claims, 5 Drawing Sheets

LIQUID JET RECORDING HEAD

This application is a division of application Ser. No. 08/355,091 filed Dec. 12, 1994 now U.S. Pat. No. 5,451,444 which was a continuation of application Ser. No. 08/258,604 filed Jun. 10, 1994, which was a continuation of application Ser. No. 08/026,169 filed Mar. 1, 1993, which was a continuation of application Ser. No. 07/821,905 filed Jan. 15, 1992, which was a continuation of application Ser. No. 07/477,148 filed Feb. 8, 1990, which was a continuation of application Ser. No. 07/296,303 filed Jan. 9, 1989, which was a continuation of application Ser. No. 07/009,062 filed Jan. 27, 1987, which was a continuation of application Ser. No. 06/674,877 filed Nov. 26, 1984, all now abandoned.

BACKGROUND OF THE INVENTION

1. Field of the Invention

This invention relates to a liquid jet recording head which performs recording by jetting a liquid to form flying liquid droplets.

2. Description of the Prior Art

Ink jet recording methods (liquid jet recording methods) are recently attracting attention because the noise they generate during recording is negligible, high speed recording is possible and also recording can be done on so-called plain paper without the need for special fixing treatments.

Among such methods, the liquid jet recording technique disclosed in, for example, Japanese Laid-open Patent Application No. 51837/1979, Deutsche Offenlegungsschrift (DOLS) 24843064 has a specific feature different from other liquid jet recording methods in that the driving force for discharging liquid droplets is obtained by permitting heat energy to act on a liquid.

More specifically, according to the recording method disclosed in the above patent specifications, liquid which has received the action of heat energy undergoes a change in state accompanied with an abrupt increase of volume, and through the acting force based on the change in state is discharged as liquid through the orifice at the tip end of the recording head section to be formed into flying liquid droplets, which liquid droplets are attached onto a material to be recorded, thereby effecting recording.

In particular, the liquid jet recording method disclosed in DOLS 2843064 is not only applicable very effectively for the so-called drop-on demand recording method, but also can easily be embodied into a recording head in which the recording head portion is made into a high density multi-orifice of the full line type, thus being capable of giving images of high resolution and high quality at high speed.

The recording head section of the device to be applied to the above-mentioned method has a liquid discharging portion having an orifice provided for discharging liquid and a liquid pathway, which is connected to the orifice and has a heat acting portion at which thermal energy acts on liquid for discharging liquid droplets, and an electro-thermal transducer as a means for generating thermal energy.

The electro-thermal transducer has a pair of electrodes and a heat-generating resistance layer which is connected to these electrodes and has a region for heat generation (heat-generating section) between these electrodes.

A typical example exhibiting the structure of such a liquid jet recording head is shown in FIG. 1A, FIG. 1B and FIG. 1C. FIG. 1A is the front view of a liquid jet recording head as seen from the orifice side, FIG. 1B is a partial sectional view of FIG. 1A when cut along the broken line X–Y and FIG. 1C is a plan view of the substrate.

The recording head 100 has a structure having orifices 104 and liquid discharging sections 105 formed by bonding a grooved plate 103 provided with a certain number of grooves of certain width and depth at a predetermined line density to a substrate 102 provided on its surface with an electro-thermal transducer 101 so as to cover the surface of the substrate 102. In the case of the recording head as shown in the drawing, it is shown as having a plural number of orifices 104. Of course, the present invention is not limited to such embodiments, but also a recording head with a single orifice is included in the category of the present invention.

The liquid discharging section 105 has an orifice 104 for discharging liquid at its terminal end and a heat acting portion 106 where thermal energy generated from an electro-thermal transducer 101 acts on liquid to generate a bubble and cause abrupt change in state through expansion and shrinkage of its volume.

The heat acting portion 106 is above the heat-generating section 107 of the electro-thermal transducer 101 and has a heat acting face 108 in contact with the liquid at the heat-generating section 107 as its bottom face.

The heat-generating section 107 is constituted of a lower layer 109, a heat-generating resistance layer 110 provided on the lower layer 109 and a first protective layer 111 provided on the heat-generating resistance layer 110. The heat-generating resistance layer 110 is provided on its surface with electrodes 113 and 114 for current flow through the layer 110. The electrode 113 is common to the heat-generating portions of the respective liquid discharging sections, while the electrode 114 is a selective electrode by selecting the heat generating portion of each liquid discharging section for heat generation and is provided along the liquid pathway of the liquid discharging section.

The first protective layer 111 has the function of separating the heat-generating resistance layer 110 from the liquid filling the liquid pathway of the liquid discharging section for protection of the heat-generating resistance layer 110 chemically or physically against the liquid employed at the heat-generating section 107, and also has the protective function for the heat generating resistance layer to prevent short-circuit through the liquid between the electrodes 113 and 114. The first protective layer 111 also serves to prevent electrical leaks between adjacent electrodes. In particular, prevention of electrical leakage between the respective electrodes or prevention of electric corrosion, which will occur by flow of electric current between the electrode under each liquid pathway and the liquid, which may happen to come into contact with each other for some cause, is important and for this purpose the first protective layer 111 having such a protective function is provided at least on the electrode existing under the liquid pathway.

Whereas, the upper layer, typically the first protective layer, is required to have characteristics which are different depending on the place at which it is to be provided. For example, at the heat-generating section 107, it is required to be excellent in (1) heat resistance, (2) liquid resistance, (3) liquid penetration preventing characteristic, (4) thermal conductivity, (5) antioxidant property, (6) insulating property and (7) breaking resistance, while in regions other than the heat-generating section 107, it must have sufficient liquid penetration prevention characteristics, liquid resistance and breaking resistance, although thermal conditions may be somewhat alleviated.

However, there is nowadays no material for constituting the upper layer which can satisfy all of the above characteristics (1) to (7) as desired, and under the present situation, some of the characteristics (1) to (7) are placed under alleviated requirements. That is to say, the choice of material in the heat-generating section is made with preference for characteristics (1), (4) and (5), while in other sections than the heat-generating section 107, for example, the electrode section, the choice of material is made with preference for characteristics (2), (3) and (7), thus forming the upper layers with the use of corresponding materials on the respective regional faces.

On the other hand, as different from these, in the case of a multi-orifice type liquid jet recording head, formation of respective layers and partial removal of the layers formed are conducted repeatedly on a substrate in the manufacturing step for the purpose of forming a number of minute electro-thermal transducers at the same time on the substrate. At the stage when the upper layer is formed, the surface on which the upper layer is to be formed is formed in minute ridged shape with a step wedge portion (stepped portion), and therefore the step coverage characteristic of the upper layer at this stepped portion becomes important. In short, if the step coverage characteristic at this stepped portion is poor, penetration of liquid will occur at that portion, whereby electric corrosion or breaking of electric insulation may be induced. Also, when the upper layer is susceptible to occurrence of failures at a fairly high probability during manufacturing, liquid will penetrate through the failures to markedly lower the life of the electro-thermal transducer.

For the reasons mentioned above, the upper layer is required to be good in step coverage characteristic at the stepped portion, low in probability of occurrence of pinholes in the layer formed or the pinholes, if any, are so few as to be negligible.

Accordingly, it has been practiced in the prior art, so as satisfy these requirements, to form the upper layer of a laminate of a first protective layer consisting of an inorganic insulating material and a second protective layer consisting of an organic material, or further to constitute a first protective layer of a double-layer structure and a lower layer of an inorganic insulating material, or to constitute an upper layer of an inorganic material which is tenacious, relatively excellent in mechanical strength and can be closely contacted and adhered with the first protective layer and the second protective layer, for example, a metal. Alternatively, a third protective layer constituted of an inorganic material such as a metal was arranged further on the second protective layer.

Although the second protective layer constituted of an organic material is excellent in coating characteristic, it is inferior in heat resistance, and therefore it is formed in a pattern as shown in FIG. 1C. However, in the case of such a constitution, the partition wall of an organic material is formed on the orifice surface formed by cutting, and said partition wall receives force during cutting to lower the mechanical strength. At the portion where mechanical strength is lowered, a part of the flying liquid droplets transmitted from the orifice surface will be penetrated to lower adhesion of the second protective layer to cause peel-off of the layer. For this reason, electrical leakage into the liquid in the liquid pathway is increased, whereby there ensues the problem that stable formation of flying liquid droplets is inhibited.

Further, since the second protective layer is formed at the portion excluding the heat-acting surface due to the characteristics of the material as mentioned above, a high step difference will result near the heat-acting surface. Higher density liquid jet recording heads are susceptible to formation of step difference near the heat-acting surface. On the other hand, in the vicinity of the heat-acting surface, foaming and condensation are repeated at a frequency of some thousand times per second, and the pressure change thereby formed will frequently destroy the second protective layer formed near the heat-acting surface.

SUMMARY OF THE INVENTION

The present invention has been accomplished in view of the various points as mentioned above and a primary object of the present invention is to provide a liquid jet recording head which is excellent in overall durability in frequently repeated uses or continuous uses for a long time and can maintain stably the initial good liquid droplet forming characteristic for a long term.

Another object of the present invention is to provide a liquid jet recording head which is high in reliability in manufacturing working.

Further object of the present invention is to provide a liquid jet recording head which is high in yield also when made into a multi-orifice type.

According to the present invention, there is provided a liquid jet recording head, comprising an electro-thermal transducer having a heat-generating resistance layer provided on a substrate, a pair of electrodes connected electrically to said heat-generating resistance layer and disposed with a gap so as to confront each other and a heat-generating section provided between these electrodes; a liquid discharging section corresponding to said electro-thermal transducer having an orifice provided for forming flying liquid droplets and a liquid pathway connected to said orifice and having a heat acting portion where heat energy for forming liquid droplets acts on liquid as a part of its constitution; and a liquid chamber for storing said liquid to be supplied to said liquid pathway, which comprises having a protective layer made of an organic material provided on the electrodes at least at the electrode portion beneath said liquid pathway, except for the vicinity of the said orifice and said heat-generating portion.

According to another object of the present invention, there is provided a liquid jet recording head, comprising an electro-thermal transducer having a heat-generating resistance layer provided on a substrate, a pair of electrodes connected electrically to said heat-generating resistance layer and disposed with a gap so as to confront each other and a heat-generating section provided between these electrodes; a liquid discharging section corresponding to said electro-thermal transducer having an orifice provided for forming flying liquid droplets and a liquid pathway connected to said orifice and having a heat acting portion where heat energy for forming liquid droplets acts on liquid as a part of its constitution; and a liquid chamber for storing said liquid to be supplied to said liquid pathway, which comprises having a protective layer made of an organic material provided at least at the electrode portion beneath said liquid pathway, only on the side of said liquid chamber relative to said heat-generating section.

BRIEF DESCRIPTION OF THE DRAWINGS

FIG. 1B a sectional view partially cut taken along the broken line XY in FIG. 1A, and FIG. 1C a schematic plan view of a bubble jet substrate;

DESCRIPTION OF THE PREFERRED EMBODIMENTS

Figure 1A:
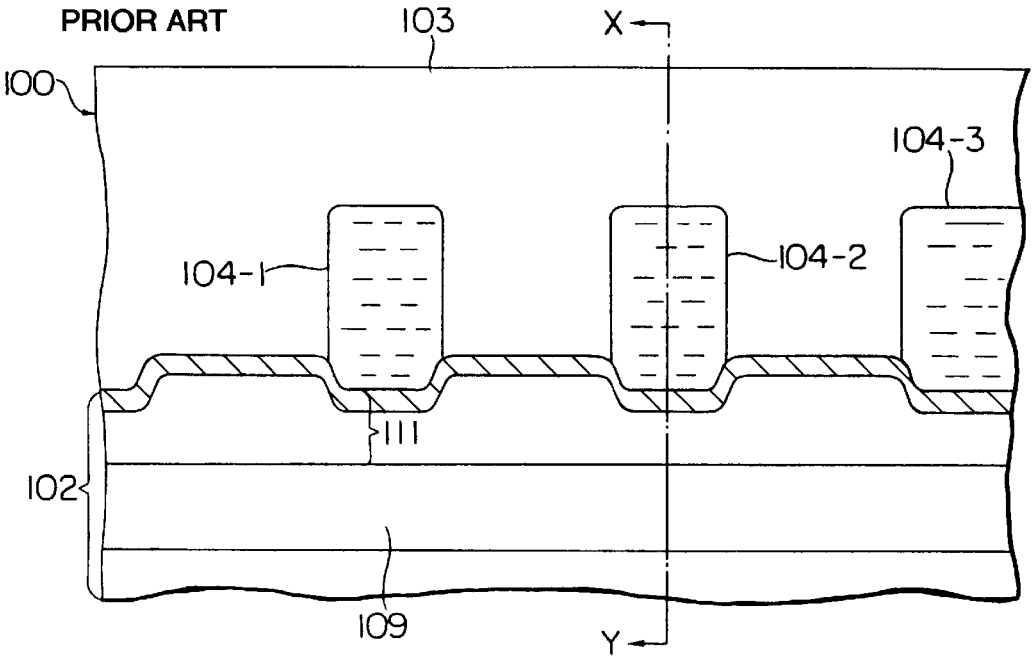
FIG. 1A PRIOR ART
FIGS. 1A, 1B and 1C are each presented for illustration of the constitution of a liquid jet recording head of the prior art, FIG. 1A showing a schematic partial front view.

Referring now to the drawings, the liquid jet recording head of the present invention is to be described in detail.

Figure 1B:
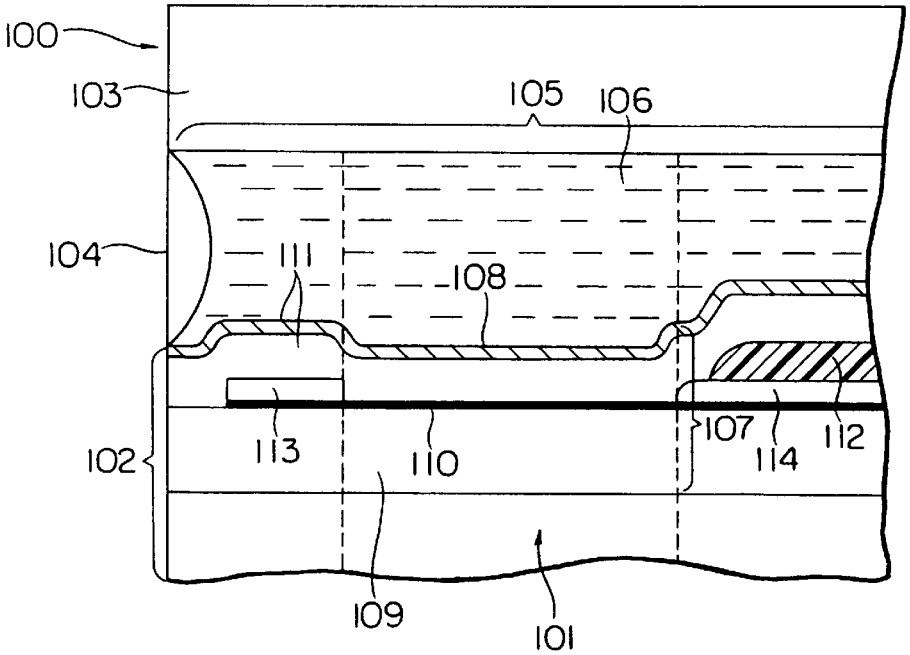
FIG. 1B PRIOR ART
Figure 1C:
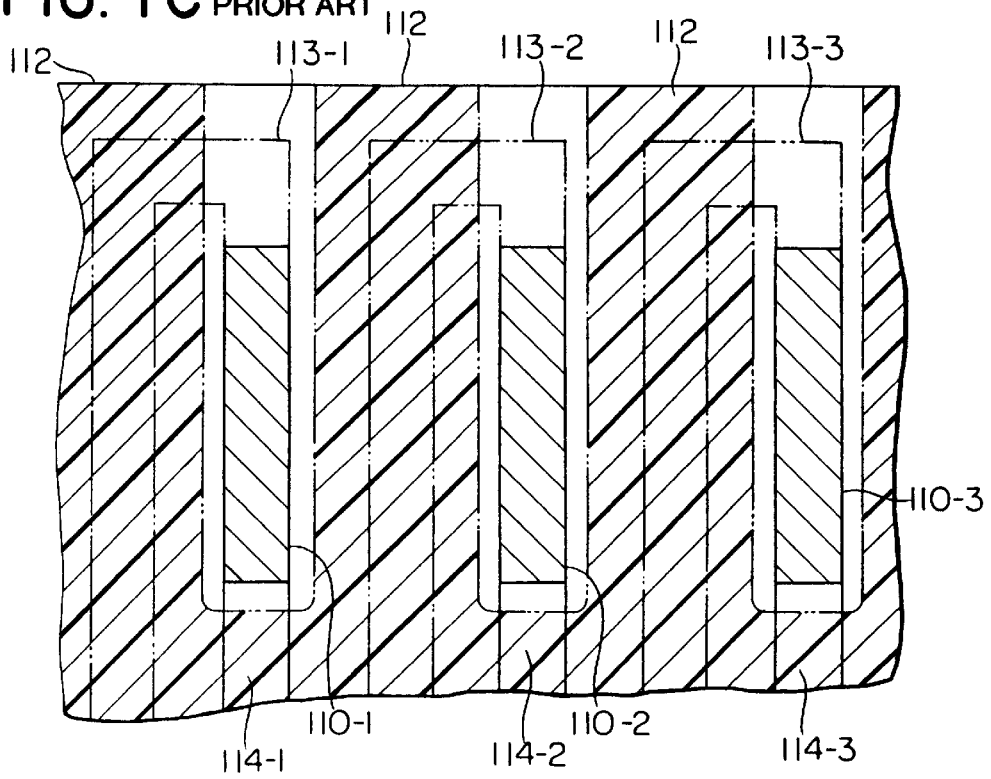
FIG. 1C PRIOR ART
Figure 2A:
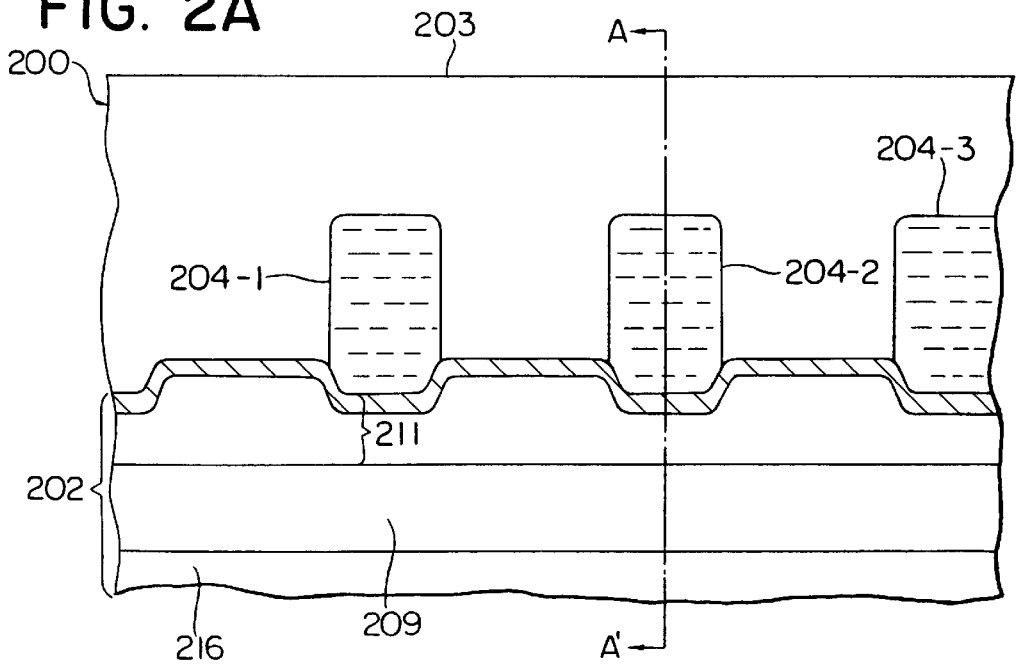
FIGS. 2A, 2B and 2C are each presented for illustration of the constitution of a first embodiment of liquid jet recording head according to the present invention, FIG. 2A showing a partial sectional view corresponding to FIG. 1A, FIG. 2B a partial sectional view taken along the chain line AA' in FIG. 2A corresponding to FIG. 1B, and FIG. 2C a schematic plan view of a bubble jet substrate corresponding to FIG. 1C.
Figure 2B:
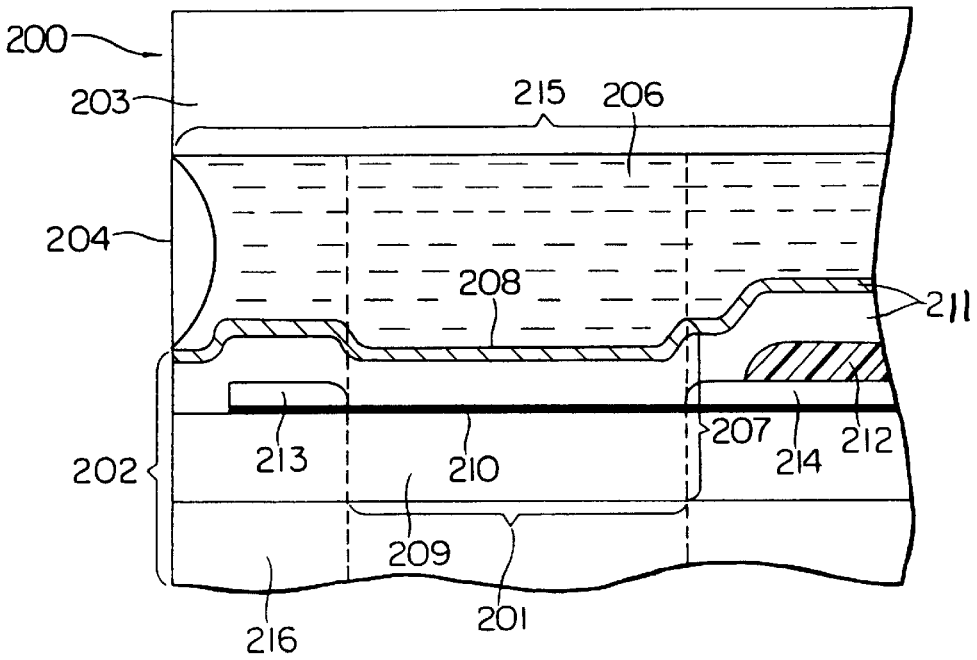
Figure 2C:
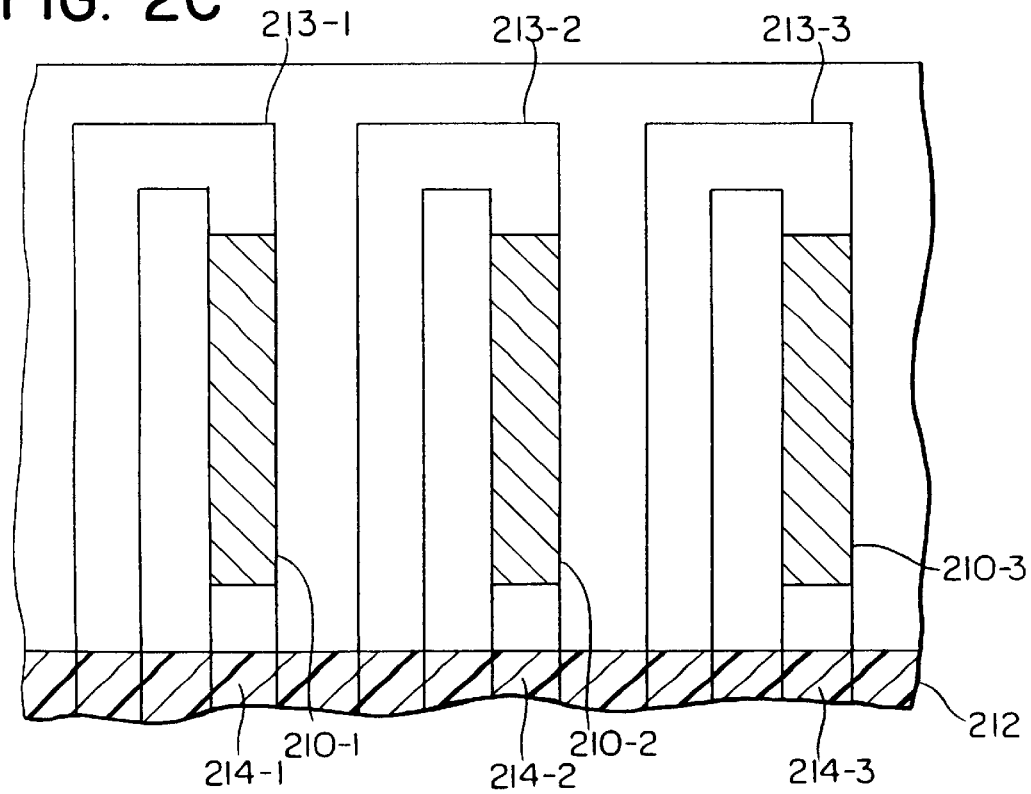

FIGS. 2A, 2B and 2C show a preferred embodiment of the liquid jet recording head of the present invention corresponding to FIGS. 1A, 1B and 1C, respectively.

In the liquid jet recording head shown in FIG. 2, the front view on the orifice side shown in FIG. 2A, is not different from that of the FIG. 1A, but, as is apparent from the sectional view passing through the liquid pathway, FIG. 2B and the plan view of substrate, no second protective layer is provided on the orifice side relative to the heat acting surface, but it is formed only on the common liquid chamber side relative to the heat acting surface.

The liquid jet recording head 200 shown in the drawings is constituted at its main part of a substrate 202 for liquid jet recording (Bubble Jet: hereinafter abbreviated as BJ) utilizing heat for liquid discharging provided with a desired number of electro-thermal transducers 201 and a grooved plate 203 having a desired number of grooves provided corresponding to said electro-thermal transducers.

The BJ substrate 202 and the grooved plate 203 are bonded to each other at predetermined positions with an adhesive or other means, whereby a liquid pathway 215 is formed by the portion of the substrate on which the electro-thermal transducer 201 is provided and the groove portion of the grooved plate 203, said liquid pathway 215 having a heat acting portion 206 as a part of its constitution.

The BJ substrate 202 has a support 216 constituted of silicon, glass, ceramics, etc., a lower layer 209 constituted of $SiO_2$, etc. provided on said support 216, a heat-generating resistance layer 210, a common electrode 213 and a selection electrode 214 provided along the liquid pathway 215 on both sides of the upper surface of the heat-generating resistance layer 210, and a first protective layer 211 which covers over the portion of the heat generating resistance layer 210 which is not covered with electrodes and the portions of electrodes 213 and 214.

The electro-thermal transducer 201 has a heat-generating section 207 as its main part, and the heat-generating section 207 is constituted of laminates provided successively from the side of the support 216, namely a lower layer 209, a heat-generating resistance layer 210, and a lower layer of the first protective layer 211 constituted of an inorganic insulating material and an upper layer of the first protective layer 211 constituted of an inorganic material, the surface of the upper layer of the first protective layer 211 (heat acting face 208) is contacted directly with the liquid filling the liquid pathway 215.

On the other hand, the surface of the selection electrode 214 is covered mostly with an upper layer comprising the second protective layer 212 and the first protective layer 211 laminated in this order from the electrode side, said upper layer being also provided in such a form at the bottom portion of the common liquid chamber provided upstream of the liquid pathway 215. The upper layer may not be formed in this order, but it can also be formed in the order of the first protective layer 211 and the second protective layer 212 from the selection electrode side. Alternatively, after formation of the lower layer of the first protective layer 211 and the second protective layer 212, the layer formed as the upper layer of the first protective layer in the liquid jet recording head as shown in FIG. 2 may be formed as the third protective layer at the outermost layer. The lower layer of the first protective layer 211 is constituted of an inorganic insulating material such as an inorganic oxide (e.g. $SiO_2$) or an inorganic nitride (e.g. $Si_3N_4$), and the upper layer constituted of a material which is tenacious, relatively excellent in mechanical strength and can be closely contacted and adhered with the lower layer of the protective layer, for example, a metal material such as Ta when the lower layer of the first protective layer is formed of $SiO_2$. Thus, by arrangement of a layer constituted of an inorganic material having relatively tenacity and mechanical strength such as a metal for the upper layer of the first protective layer, the shock from the cavitation action generated in liquid discharging, particularly at the heat acting surface 208, can sufficiently be absorbed to give the effect of elongating to a great extent the life of the electro-thermal transducer 201. The upper layer of the first protective layer 211 has also the same effect, even when formed as the third protective layer as described above.

In the case of the liquid jet recording head 200 shown in FIG. 2, the common electrode is covered only with the protective layer 211.

The material for constituting the lower layer of the first protective layer 211 may suitably be an inorganic insulating material excellent in thermal conductivity and heat resistance, for example, inorganic oxides such as $SiO_2$, etc.; transition metal oxides such as titanium oxide, vanadium oxide, niobium oxide, molybdenum oxide, tantalum oxide, tungsten oxide, chromium oxide, zirconium oxide, hafnium oxide, lanthanum oxide, yttrium oxide, manganese oxide and the like; metal oxides such as aluminum oxide, calcium oxide, strontium oxide, barium oxide, silicon oxide and complexes thereof; high resistance nitrides such as silicon nitride, aluminum nitride, boron nitride, tantalum nitride, etc. and complexes of these oxides and nitrides; further thin film materials such as semiconductors of amorphous silicon, amorphous selenium, etc. which have low resistance as bulk but can be made to have high resistance during the manufacturing steps such as by the sputtering method, the CVD method, the vapor deposition method, the gas phase reaction method, the liquid coating method and others.

As the material which can form the upper layer of the first protective layer and the third protective layer, in addition to Ta as mentioned above, there may be employed the elements of the group IIIa of the periodic table such as Sc, Y and others, the elements of the group IVa such as Ti, Zr, Hf and others, the elements of group Va such as V, Nb and others, the elements of the group VIa such as Cr, Mo, W and others, the elements of the group VIII such as Fe, Co, Ni and others; alloys of the above metals such as Ti-Ni, Ta-w, Ta-Mo-Ni, Ni-Cr, Fe-Co, Ti-W, Fe-Ti, Fe-Ni, Fe-Cr, Fe-Ni-Cr and others; borides of the above metals such as Ti-B, Ta-B, Hf-B, W-B and others; carbides of the above metals such as Ti-C, Zr-C, V-C, Ta-C, Mo-C, Ni-C and others; silicides of the above metals such as Mo-Si, W-Si, Ta-Si and others; nitrides of the above metals such as Ti-N, Nb-N, Ta-N and others; and so on. The upper layer of the first protective layer and the third protective layer can be formed by use of these materials according the vapor deposition method, the sputtering method, the CVD method, etc. The upper layer of the first protective layer and the third protective layer can be a single layer as described or alternatively some of these can of course be combined. Also, for the third protective layer, in place of a single layer as mentioned above, such a layer may be combined with the material for the lower layer of the first protective layer, as the first protective layer shown in FIG. 2.

The second protective layer 212 is constituted of an organic insulating material excellent in prevention of liquid penetration and liquid resistance and it is further desired to have such physical properties as (1) good film forming property, (2) close structure with few pinholes, (3) will not swell or dissolve in the ink employed, (4) good insulating property when fabricated into film and (5) high heat resistance. Such organic materials may include the following resins, for example, silicone resin, fluorine resin, aromatic polyamide, addition polymerization type polyimide, polybenzimidazole, metal chelate polymer, titanic acid ester, epoxy resin, phthalic acid resin, thermosetting phenolic resin, p-vinylphenol resin, Zirox resin, triazine resin, BT resin (triazine resin and bismaleimide addition polymerized resin) and others. Other than these, it is also possible to form the second protective layer 212 by vapor deposition of a polyxylylene resin or derivatives thereof.

Further, the second protective layer 212 can also be formed by film formation according to the plasma polymerization with the use of various organic monomers, including, for example, thiourea, thioacetamide, vinyl ferrocene, 1,3,5-trichlorobenzene, chlorobenzene, styrene, ferrocene, pyrroline, naphthalene, pentamethylbenzene, nitrotoluene, acrylonitrile, diphenyl selenide, p-toluidine, p-xylene, N,N-dimethyl-p-toluidine, toluene, aniline, diphenyl mercury, hexamethylbenzene, malononitrile, tetracyanoethylene, thiophene, benzeneselenol, tetrafluoroethylene, ethylene, N-nitrosodiphenylamine, acetylene, 1,2,4-trichlorobenzene, propane, etc.

However, if it is desired to prepare a high density multi-orifice type recording head, an organic material different from those as mentioned above which can very easily be subjected to minute lithographic working may desirably be employed as the material for forming the second protective layer 212. Examples of such organic materials may include a polyimidoisoindiloquinazoline dione (trade name: PIQ, produced by Hitachi Kasei Co.), a polyimide resin (trade name: PYRALIN, produced by Du Pont), a cyclized polybutadiene (trade name: JSR-CBR, CBR-M901, produced by Japan Synthetic Rubber Co.), Photonith (trade name: produced by Toray Co.), and other photosensitive polyimide resins as preferable ones.

The lower layer 209 is provided as a layer for controlling the flow of heat generated primarily from the heat-generating section 207 toward the side of the support 216. The material and the layer thickness for the lower layer are chosen so that, when heat energy is permitted to act on liquid at the heat acting section 206, the heat generated from the heat-generating section 207 may be controlled to flow in greater amount towards the side of the heat acting section 206, while when current passage to the electro-thermal transducer 201 is turned off, the heat remaining in the heat generating section 207 may flow rapidly toward the side of the support 216. Examples of the materials constituting the lower layer 209 may include $SiO_2$ as previously mentioned and inorganic materials, typically metal oxides such as tantalum oxide, magnesium oxide, aluminum oxide and the like.

For the material constituting the heat-generating resistance layer 210, it is possible to employ most of the materials which can generate heat as desired by passage of current.

More specifically, such materials may include, for example, tantalum nitride, nickel-chromium, silver-palladium alloy, silicon semiconductors, or metals such as hafnium, lanthanum, zirconium, titanium, tantalum, tungsten, molybdenum, niobium, chromium, vanadium, etc., alloys thereof and borides thereof as preferable ones.

Among the materials constituting the heat-generating resistance layer 210, a metal boride will be preferred, and above all hafnium boride has the best characteristics, and next to this compound there are zirconium boride, lanthanum boride, vanadium boride and niobium boride with better characteristics in the order mentioned.

The heat-generating resistance layer 210 can be formed by use of the materials as mentioned above according to the method such as electron beam vapor deposition or sputtering.

As the material constituting the electrodes 213 and 214, most of the electrode materials conventionally employed may be used effectively. For example, there may be employed metals such as Al, Ag, Au, Pt, Cu, etc. By use of these materials, electrodes are provided at predetermined positions to desired sizes, shapes and thicknesses by vapor deposition or the like.

As the material constituting the constituent member for the common liquid chamber provided on the side upstream of the grooved plate 203 and the heat acting section 206, most of the materials are effectively available, so long as they are free or substantially free from the influence on their shape by the heat created by working of the recording head or in the environment encountered during usage and are capable of being applied with minute precise working easily an attaining a precision face surface, and further can be worked so that the liquid may flow smoothly through the pathways formed by such workings.

Typical examples of such materials may include ceramics, glass, metal, plastic or silicon wafer as preferable ones. In particular, glass or silicon wafer is one of preferable materials, since it can easily be worked and has appropriate heat resistance, thermal expansion coefficient and thermal conductivity. In order to prevent the outside of the orifice 204 from coming therearound of the liquid leaked, it is preferred to apply on the outer surface around the orifice 204 water repelling treatment in the case of an aqueous liquid and oil repelling treatment in the case of a non-aqueous liquid.

Figure 3A:
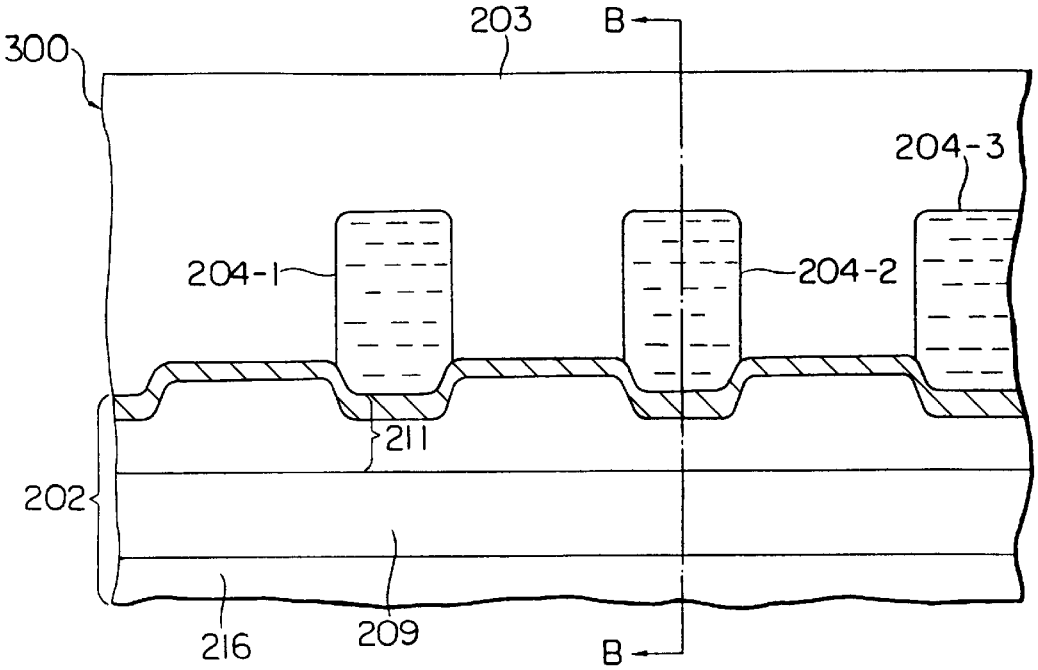
FIGS. 3A, 3B and 3C are each presented for illustration of the constitution of a second embodiment of liquid recording head according to the present invention, FIG. 3A showing a partial sectional view corresponding to FIG. 1A, FIG. 3B a partial sectional view taken along the chain line BB' in FIG. 3A corresponding to FIG. 1B, and FIG. 3C a schematic plan view of a bubble jet substrate corresponding to FIG. 1C.
Figure 3B:
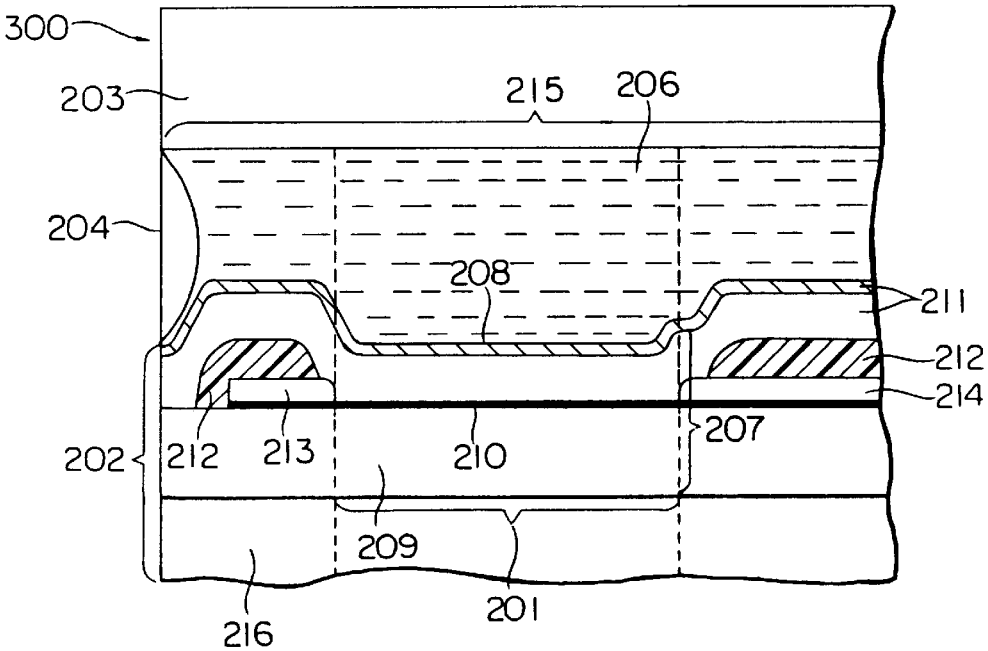
Figure 3C:
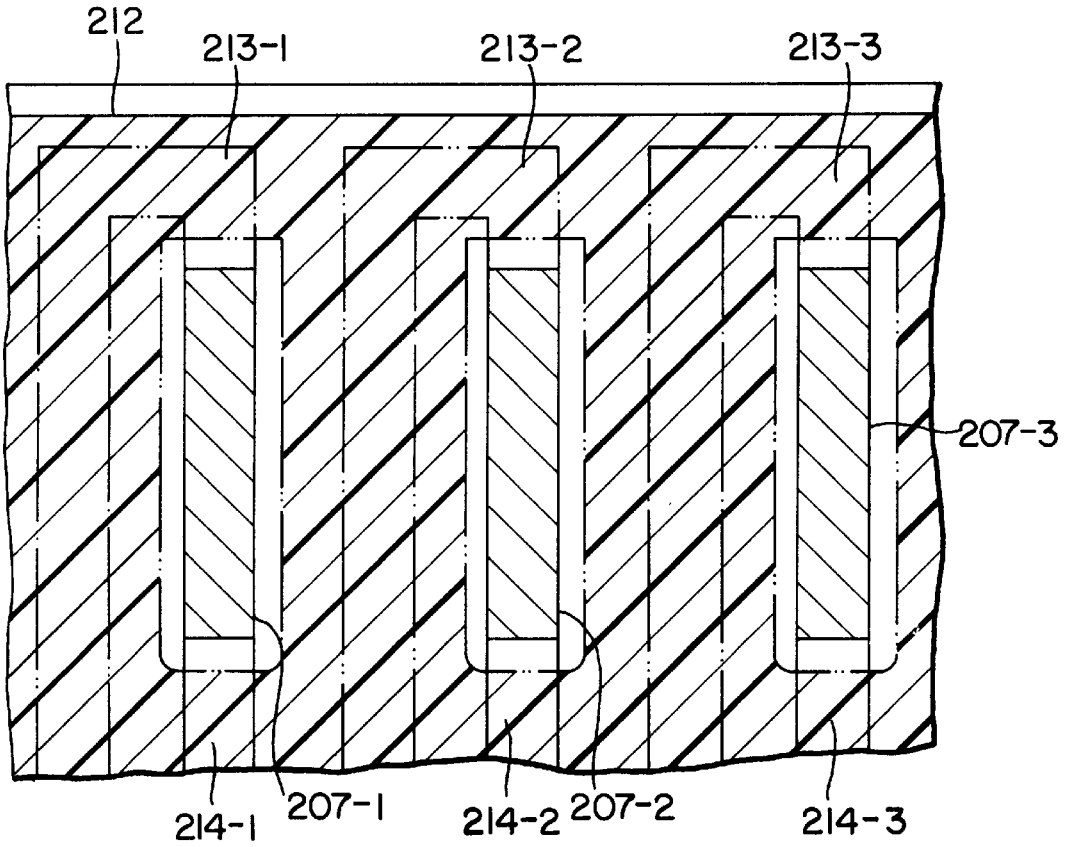

FIGS. 3A, 3B and 3C shown a second preferred embodiment of the liquid jet recording head according to the present invention corresponding to FIGS. 1A, 1B and 1C respectively.

In the liquid jet recording head 300 shown in FIGS. 3A, 3B and 3C, FIG. 3A showing the front view on the orifice side is the same as FIG. 1A, but, as apparently seen from the sectional view FIG. 3B passing through the liquid pathway and the substrate plan view FIG. 3C, the second protective layer is omitted in the vicinity of an edge of the support at the orifice surface and from on the heat-generating section. That is to say, the liquid jet recording head 300 shown in FIGS. 3A, 3B and 3C has the same constitution as the liquid jet recording head 200 shown in FIGS. 2A, 2B and 2C except that the protective layer 212 is provided excluding the heat-generating section 207 (207-1, 207-2, 207-3) and the orifice surface, as shown in FIG. 3C.

In the liquid jet recording head 300, the distance between the orifice surface and the protective layer 212 made of an organic material should preferably be at least 30 μm.

The liquid jet recording head of the present invention is now described in detail by referring to Examples.

EXAMPLE 1

The liquid jet recording head as shown in FIGS. 2A, 2B and 2C was prepared according to the following procedure.

An Si wafer was thermally oxidized to be formed into a $SiO_2$ film with a thickness of 5 μm to provide a substrate. On the substrate was formed by sputtering a heat generating resistance layer of $HfB_2$ to a thickness of 1500 Å, followed successive deposition of Ti layer of 50 Å and Al layer of 5000 Å according to electron beam vapor deposition.

By way of the photolithographic steps, the pattern as shown in FIG. 2C was formed to form electrodes 213 and 214. The size of the heat acting face was found to be 30 μm in width and 150 μm in length, with the resistance being 150 ohm, including the resistance of the electrodes.

Then, as the second protective layer 212, a PIQ layer with a thickness of 2.0 μm was prepared on the hatched portion in FIG. 2C according to the following steps.

The substrate having the heat-generating resistance layer and the electrodes in desired patterns was washed, dried and coated with a PIQ solution by a spinner (spinner rotation conditions under coating conditions: the first step 500 rpm, 10 sec., the second step 4000 rpm, 40 sec.). Next, the coated product was left to stand at 80° C. for 10 minutes and, after the solvent was evaporated off, baked tentatively at 200° C. for 60 minutes. A photoresist OMR-83 (produced by Tokyo Oka Co.) was then applied on the coated layer by a spinner and after drying subjected to exposure by use of a mask aligner, followed by development processing to obtain a desired PIQ layer pattern. Subsequently, etching of the PIQ layer was performed with an etchant for PIQ at room temperature. After washing with water and drying, the photoresist was peeled off with a peeling liquid for OMR, followed by baking at 350° C. for 60 minutes to complete the steps for forming the PIQ layer pattern.

The PIQ layer had a thickness of 2.0 μm at the portion where there is no heat-generating resistance layer and electrode on the substrate, and a thickness of 1.8 μm on the heat-generating resistance layer and the electrode surfaces. This exhibits good step coverage characteristic.

Subsequent to formation of the PIQ layer pattern, a $SiO_2$ sputter layer was deposited by high rate sputtering to 2.2 μm as the lower layer of the first protective layer 211, followed further by lamination of a Ta layer 0.5 μm thick by sputtering of Ta as the upper layer of the first protective layer 211.

As the next step, on the BJ substrate, a grooved glass plate was adhered as designed. That is, similarly as shown in FIG. 2B, there adhered a grooved glass plate (groove size: width 50 μm×depth 50 μm×length 2 mm) for forming an ink inlet pathway and a heat acting portion on the BJ substrate.

When a rectangular voltage of 10 μS and 30 V was applied at 800 Hz on the electro-thermal transducer of the recording head thus prepared, the liquid was discharged corresponding to the signals applied to form flying liquid droplets stably.

Liquid jet recording heads with nozzle densities of 6/mm, 8/mm and 12/mm were prepared according to the constitution as described in this Example and the constitution as shown in FIG. 1, respectively. The discharging test for flying liquids droplets continuously was conducted for each head and comparison was made with respect to the percentage of failures at $10^8$ pulse to obtain the results as shown in Table 1 (each test being conducted for 1000 samples).

TABLE 1

| | Nozzle density: | | |
|---|---|---|---|
| Constitution | 6/mm | 8/mm | 12/mm |
| Prior art | 0.1% | 0.2% | 7.2% |
| Example | 0.08% | 0.1% | 0.4% |

As apparently seen from the results in Table 1, the head of the present invention is hardly increased in percentage of failure at $10^8$ as compared with the prior art example, even when the nozzle density may be increased, thus indicating excellent durability and reliability.

Also, the liquid jet recording head of this Example could maintain stably the good liquid-droplet-forming characteristic at the initial stage for a long term. Further, it was high in reliability in the manufacturing working, and the production yield when making a multi-orifice was also high.

EXAMPLE 2

The liquid jet recording head as shown in FIGS. 3A, 3B and 3C was prepared according to the following procedure.

An Si wafer was thermally oxidized to be formed into a $SiO_2$ film with a thickness of 5 μm to provide a substrate. On the substrate was formed by sputtering a heat generating resistance layer of $HfB_2$ to a thickness of 1500 Å, followed successive deposition of Ti layer of 50 Å and Al layer of 5000 Å according to electron beam vapor deposition.

By way of the photolithographic steps, the pattern as shown in FIG. 3C was formed to form electrodes 213 and 214. The size of the heat acting face was found to be 30 μm in width and 150 μm in length, with the resistance being 150 ohm, including the resistance of the electrodes.

Next, as the second protective layer 212, a PIQ layer with a thickness of 2.0 μm was prepared on the hatched portion in FIG. 3C according to the following steps.

The substrate having the heat-generating resistance layer and the electrodes in desired patterns was washed, dried and coated with a PIQ solution by a spinner (spinner rotation conditions under coating conditions: the first step 500 rpm, 10 sec., the second step 4000 rpm, 40 sec.). Next, the coated product was left to stand at 80° C. for 10 minutes and, after the solvent was evaporated off, baked tentatively at 220° C. for 60 minutes. A photoresist OMR-83 (produced by Tokyo Oka Co.) was then applied on the coated layer by a spinner and after drying subjected to exposured by use of a mask aligner, followed by development processing to obtain a desired PIQ layer pattern. Subsequently, etching of the PIQ layer was performed with an etchant for PIQ at room temperature. After washing with water and drying, the photoresist was peeled off with a peeling liquid for OMR, followed by baking at 350° C. for 60 minutes to complete the steps for forming the PIQ layer pattern.

The PIQ layer had a thickness of 2.0 μm at the portion where there is no heat-generating resistance layer and electrode on the substrate, and a thickness of 1.8 μm on the heat-generating resistance layer and the electrode surfaces. This exhibits good step coverage characteristic.

Subsequent to formation of the PIQ layer pattern, a $SiO_2$ sputter layer was deposited by high rate sputtering to 2.2 μm as the lower layer of the first protective layer 211, followed further by lamination of a Ta layer 0.5 μm thick by sputtering of Ta as the upper layer of the first protective layer 211.

As the next step, on the BJ substrate, a grooved glass plate was adhered as designed. That is, similarly as shown in FIG. 3B, there is adhered a grooved glass plate (groove size: width 50 μm×depth 50 μm×length 2 mm) for forming an ink inlet pathway and a heat acting portion on the BJ substrate.

When a rectangular voltage of 10 μS and 30 V was applied at 800 Hz on the electro-thermal transducer of the recording head thus prepared, the liquid was discharged corresponding to the signals applied to form flying liquid droplets stably.

The liquid-jet recording head of this Example as described above could maintain stably the good liquid-droplet-forming characteristic at the initial stage for a long term. Further, it was high in manufacturing reliability, and the production yield when making a multi-orifice was also high.

It is claimed:

1. A liquid jet recording head for discharging liquid droplets onto a recording medium comprising:

a support;

a heat-generating resistance layer provided on said support for generating heat energy to be utilized for discharging the liquid droplets;

a plurality of pairs of electrodes electrically connected to said heat-generating resistance layer;

a plurality of heat-generating sections each serving as a portion for generating the heat energy, each said heat-generating section comprising a portion of the heat-generating resistance layer extending between a corresponding one of said pairs of electrodes, said heat-generating sections being provided with a density of at least 12/mm;

a plurality of discharge openings for discharging liquid droplets;

a liquid chamber for housing liquid;

a plurality of liquid paths, each said liquid path having an associated one of said heat-generating sections, and communicating with an associated one of said discharge openings and with said liquid chamber to supply liquid to the associated said discharge opening from said liquid chamber; and an upper layer provided on said support to protect said heat-generating resistance layer and said pair of electrodes, wherein said upper layer has an organic resin layer comprising an organic material, and wherein said organic resin layer is formed only on the common liquid chamber side relative to the heat acting surface and no part of said upper layer is provided on the orifice side relative to the heat acting surface, whereby said organic resin layer is located in said liquid paths entirely on a whole region upstream of said plurality of heat-generating sections on said support in a liquid supply direction, said upper layer further having an inorganic insulating layer which covers the whole of said heat-generating resistance layer and pair of electrodes.

2. A liquid jet recording head for discharging liquid droplets onto a recording medium comprising:

a support;

a heat-generating resistance layer provided on said support for generating heat energy to be utilized for discharging the liquid droplets;

a plurality of pairs of electrodes electrically connected to said heat-generating resistance layer;

a plurality of heat-generating sections each serving as a portion for generating the heat energy, each said heat-generating section comprising a portion of the heat-generating resistance layer extending between a corresponding one of said pairs of electrodes, said heat-generating sections being provided with a density of at least 12/mm;

a plurality of discharge openings for discharging liquid droplets;

a liquid chamber for housing liquid;

a plurality of liquid paths, each said liquid path having an associated one of said heat-generating sections, and communicating with an associated one of said discharge openings and with said liquid chamber to supply liquid to the associated said discharge opening from said liquid chamber; and an upper layer provided on said support to protect said heat-generating resistance layer and said pair of electrodes, wherein said upper layer has an organic resin layer comprising an organic material, and wherein said organic resin layer is formed only on the common liquid chamber side relative to the heat acting surface and no part of said upper layer is provided on the orifice side relative to the heat acting surface, whereby said organic resin layer is formed on said electrodes except for the whole of a region which includes said plurality of heat-generating sections and which extends therefrom in a direction downstream of said plurality of heat-generating sections, said upper layer further having an inorganic insulating layer which covers the whole of said heat-generating resistance layer and pair of electrodes.

3. The liquid jet recording head according to claim 2, wherein said upper layer further comprises an inorganic upper layer comprising an inorganic material.

4. The liquid jet recording head according to claim 3, wherein said upper layer further comprises an inorganic upper layer comprising an inorganic material.

* * * * *

UNITED STATES PATENT AND TRADEMARK OFFICE

CERTIFICATE OF CORRECTION

PATENT NO. : 5,992,983

DATED : November 30, 1999

INVENTOR(S) : HIROTO TAKAHASHI ET AL.

It is certified that error appears in the above-identified patent and that said Letters Patent is hereby corrected as shown below:

ON THE TITLE PAGE

[57] ABSTRACT:

Line 7, "head" should read --heat--; and
Line 15, "An" should read --A--.

COLUMN 7:

Line 4, "according" should read --according to--.

COLUMN 10:

Line 1, "liquids" should read --liquid--; and
Line 52, "exposured" should read --exposure--.

Signed and Sealed this

Thirtieth Day of January, 2001

*Attest:*

Q. TODD DICKINSON

*Attesting Officer*

*Director of Patents and Trademarks*